US005136916A

United States Patent [19]

Shibukawa

[11] Patent Number: 5,136,916

[45] Date of Patent: Aug. 11, 1992

[54] ELECTRONIC MUSICAL INSTRUMENT

[75] Inventor: Takeo Shibukawa, Hamamatsu, Japan

[73] Assignee: Yamaha Corporation, Hamamatsu, Japan

[21] Appl. No.: 670,698

[22] Filed: Mar. 18, 1991

[30] Foreign Application Priority Data

Mar. 19, 1990 [JP] Japan ..... 2-069183

[51] Int. Cl.[5] ..... G10H 1/04; G10H 7/04

[52] U.S. Cl. ..... 84/627; 84/628; 84/629; 84/663

[58] Field of Search ..... 84/605, 619, 626–630, 84/657, 662, 663, 702, 704

[56] References Cited

U.S. PATENT DOCUMENTS 4,122,743 10/1978 Tomisawa et al. ..... 84/605
4,463,647 8/1984 Luce ..... 84/DIG. 7
4,726,276 2/1988 Katoh et al. ..... 84/663
4,794,838 1/1989 Corrigan, III ..... 84/478 X
4,909,121 3/1990 Usa et al. ..... 84/606
4,966,051 10/1990 Tajima ..... 84/663

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electroic musical instrument of the present invention is provided with a damper control as well as tone generation instructin device and tone generation device. While the damper control is operated, the tone generation device continues tone generation even if the stop thereof is instructed by the tone generation instruction device. Moreover there is provided pitch control device adapted to change the pitch of the tone currently generated while the damper control is operated.

Accordingly, when the damper control is operated, the resulting musical tones can be enhanced in their variety, distinct from normal tone generation. This allows an electronic musical instrument, for example, to generate such sounds as when the damper pedal is stamped with a piano.

18 Claims, 4 Drawing Sheets

ELECTRONIC MUSICAL INSTRUMENT

BACKGROUND OF THE INVENTION

1. Field of the Invention

The present invention relates to electronic musical instruments provided with a damper control such as a damper pedal.

2. Description of the Prior Art

For some years there have been developed into practical use electronic musical instruments provided with a damper control such as a damper pedal. The damper control, when operated during the generation of tones related to sustained ones, such as string tones (tones which are sustained without decay until playing operation is stopped.), allows the tones to continue being generated at the same level of the tone generation even if the tone-generating operation is stopped, that is, a key-off on key board or bress-off on wind type instrument is effected. On the other hand, when the damper control is operated during the generation of tones related to damping ones, such as piano tones (tones which decay according to a specified envelope line of the tones until playing operation is stopped.), it allows the tones to continue being generated according to the decaying envelope line of the tones even if the tone-generating operation is stopped.

In the case of natural musical instruments, for instance, in pianos, when the damper pedal is stamped, there arise unique sounds in addition to the continuing tones as described above. These additional sounds are caused by resonance that is attributed to, for example, the fact that not only strings undergoing tone generation but also those not (i.e. strings not involved in key touch) are subjected to damper release as the damper pedal is stamped.

Conventionally, various proposals have been made to reproduce such sounds in electronic musical instruments. The proposals include one disclosed in Japanese Patent Laid-Open Publication SHO 64-91193, which proposes that when the pedal is stamped, not only normal tones (those generated while the damper pedal is off) but also resonant tones formed according thereto are mixed together in tone generation so that the above-mentioned unique sounds can be reproduced.

Such method of reproduction, however, is effected by forming resonant tones according to normal tones generated by a tone synthesizer and then mixing them with the original normal tones for tone generation, thus accompanied by a deficiency that musical tones full of sophistication and variety cannot be obtained.

SUMMARY OF THE INVENTION

Accordingly, it is the primary object of the present invention is to provide an electronic musical instrument capable of generating musical tones full of sophistication and variety by, when a damper control such as a damper pedal is operated, changing the pitches of musical tones themselves generated by tone generation means.

In accomplishing this and other objects, the present invention provides an electronic musical instrument comprising: tone generation instruction means for instructing the generation of musical tones and the stop of tone generation; tone generation means for generating musical tones according to the instruction of the tone generation instruction means; and a damper control for changing and controlling the aspect of tone generation in the tone generation means after the stop of tone generation is instructed by the tone generation instruction means, the tone generation means having pitch control means for changing the pitches of tones that are generated when the damper control is operated.

The electronic musical instrument according to the present invention is adapted to make the pitches of musical tones generated by the tone generation means subtly out of tune when the damper control is operated, thereby rendering the musical tones full of variety effectively.

BRIEF DESCRIPTION OF THE DRAWINGS

These and other objects and features for the present invention will become apparent from the following description taken in conjunction with the preferred embodiment thereof with reference to the accompanying drawings, in which.

DESCRIPTION OF THE PREFERRED EMBODIMENTS

The electronic keyboard instrument as illustrated is a piano-type electronic keyboard instrument so called an electronic piano, the tone synthesizing method of which is of a waveform memory reading method. The waveform memory reading method is such that a sampled tone waveform is digitized and written into a ROM, wherein when a key is turned on, this digitized data is read according to the tempo clock corresponding to the pitch of the key. The electronic musical instrument mentioned here, having a waveform memory stereo-sampled in two channels, on left (L) and right (R) sides, is capable of stereophonic tone generation. Besides, the instrument has a waveform memory for fortissimo (ff) waveforms monaural-sampled, being adapted to apply cross-fading to the right and left channels according to the touch by which keys are turned on. As this instrument can simultaneously generate 16 tones, the L, R, and ff channels each have 16 time-shared channels set therein in synchronism with clocks in order to independently form the 16 tones. As in the piano, a natural musical instrument, the electronic musical instrument includes a damper pedal (pedal type operator), being adapted to effect an action of subtly shifting the tune in the three lines (detuning) depending on how deep the pedal is stamped, so that the musical tones generated when the damper pedal is stamped can be full of unique variety. Moreover, the instrument is also provided with such functions as can add thereto some effects including tremolos and vibratos, which are not provided to natural muscial instruments. When these functions are instructed, an LFO (Low Frequency Oscillator) serves to modulate the number of frequency on each time-shared channel so as to produce the above-mentioned effects.

Figure 1:
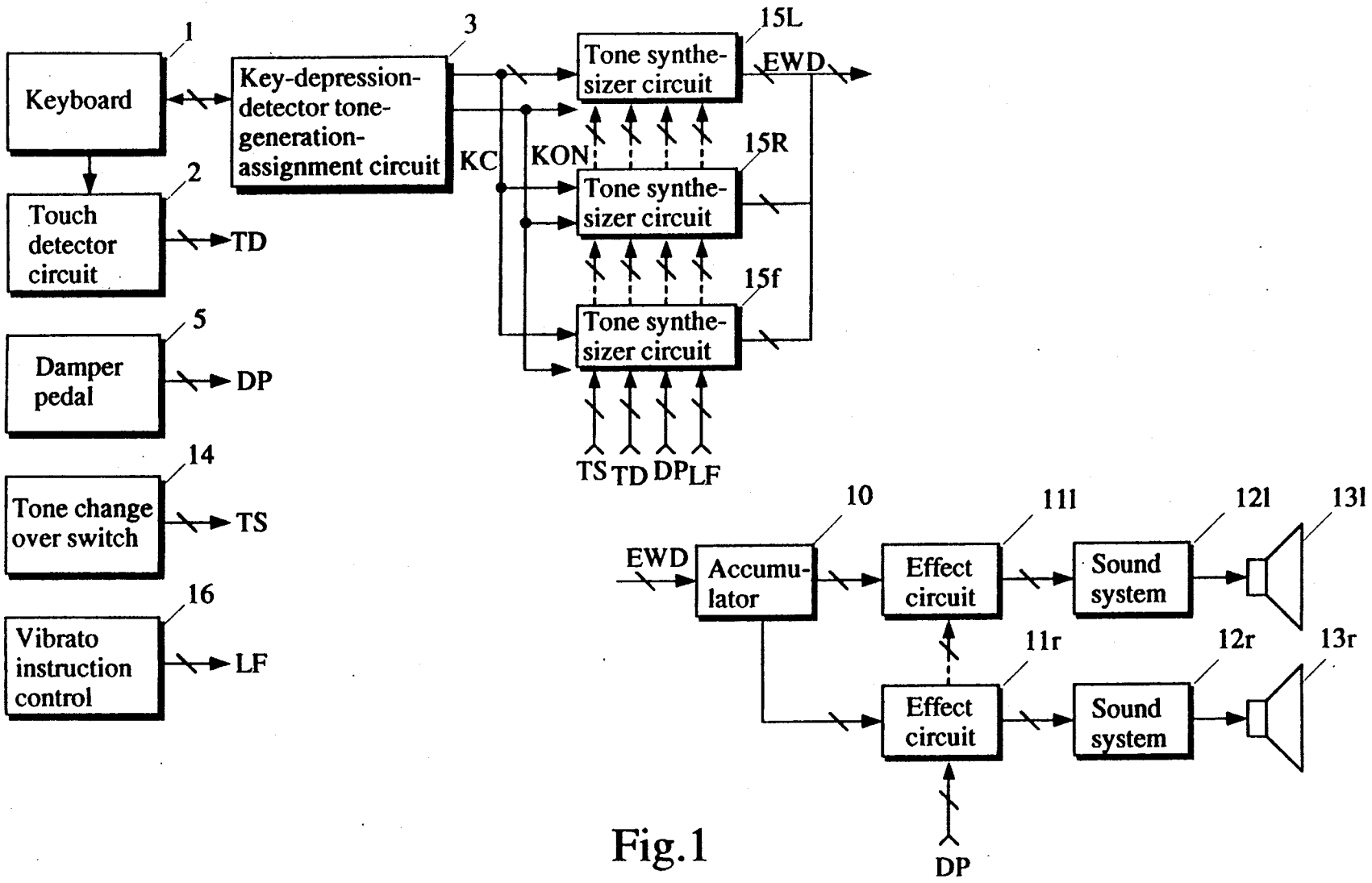
FIG. 1 is a block diagram of an electronic keyboard instrument of an embodiment according to the present invention.

FIG. 1 is a block diagram of the electronic keyboard instrument described above, where a keyboard 1 has 88 keys, each key constructed so as to allow at least its initial touch as well as its key-on or key-off to be detected. The mechanism by which an initial touch thereof is detected maybe, for example, such that two switches different in the depth at which they are turned on are provided so as to detect the speed of key depression depending on the difference in the time at which the two switches are turned on. Although there have already been proposed various types of methods therefore any one may be used only if it can detect the speed and pressure of key depression. The keyboard 1 is connected with both a touch detector circuit 2 and a key-depression-detector tone-generation-assignment circuit 3. The touch detector circuit 2 is a circuit which detects the initial touch signal TD of a key that has been turned on and outputs it in synchronization with time-shared timing. The key-depression-detector tone-generation-assignment circuit 3 is adapted to continuously scan the keys of the keyboard 1, thereby deciding what keys or keys are being depressed. When this key-depression-detector tone-generation-assignment circuit 3 detects a new key-depression, the circuit assigns tone generation to a timed-shared channel that generates the tone of a key code KC corresponding to the key turned on. The assignment of tone generation is carried out as an operation in which a key code KC and a key-on signal KON are output at the timing of the relevant time-shared channel. The timing at which the above-mentioned signal TD is output is also synchronized with this operation.

A damper pedal 5 is provided at the leg portion of the electronic keyboard instrument, or at an player's feet, being operated by stamping of foot (normally, right foot) while the player is playing the keyboard 1 by hand. When the damper pedal 5 is operated, a damper pedal stamping signal DP is produced, serving for instructing the detuning to tone synthesizer circuits 15 (15L, 15R, and 15f), described later, for controlling the envelope profile, and for other functions. The damper pedal 5, in this case, outputs data of 0 to 7 (3 bits) depending on how deep the pedal is stamped. Further, on the control panel of the electronic keyboard instrument there are provided a tone changeover switch 14 and a vibrato instruction control 16. Their output signals TS and LF are sent to the tone synthesizer circuits 15, mentioned below.

To this electronic keyboard instrument there are provided three tone synthesizer circuits 15, a left-channel tone synthesizer circuit 15L, a right-channel tone synthesizer circuit 15R, and a fortissimo tone synthesizer circuit 15f. Each of them receives the above-mentioned signals TS, LF, and TD, DP and, still more, the key code KC and key-on signal KON from the key-depression-detector tone-generation-assignment circuit 3. The tone synthesizer circuits 15 outputs a predetermined tone waveform to an accumulator 10 according to the input signals. The accumulator 10 accumulates envelope-treated time-shared tone signals EWD (tone signals output from the tone synthesizer circuits 15), releases the time-shared state, assigns L and R signals to corresponding channels, and outputs them as SL and SR. The accumulation is done both for cross-fading of the three-line tones, L-, R-, and ff-related ones and for the synthesization of the time-shared channel tones. Synthesized tones, SR and SL are fed to effect circuits 11 (11 and **11*r*) on the right and left channels, respectively. The effect circuits 11 are adapted to impart such effects as reverb to tones depending on the damper pedal stamping signal DP, more particularly, to adjust the damping ratio of reverbs depending on how deep the damper pedal is stamped. The operation mentioned above is carried out as a treatment of digital signals (not interpolated signals). Sound systems 12 (12 and 12*r*) perform D/A conversion on input tone signals, amplification of analog-converted signals, and the like. The gain in the amplification is set by a volume, not shown, or the like. The tone signals amplified by the sound systems 12 are output from speakers 13 (13 and 13*r***) as sounds.

Figure 2:
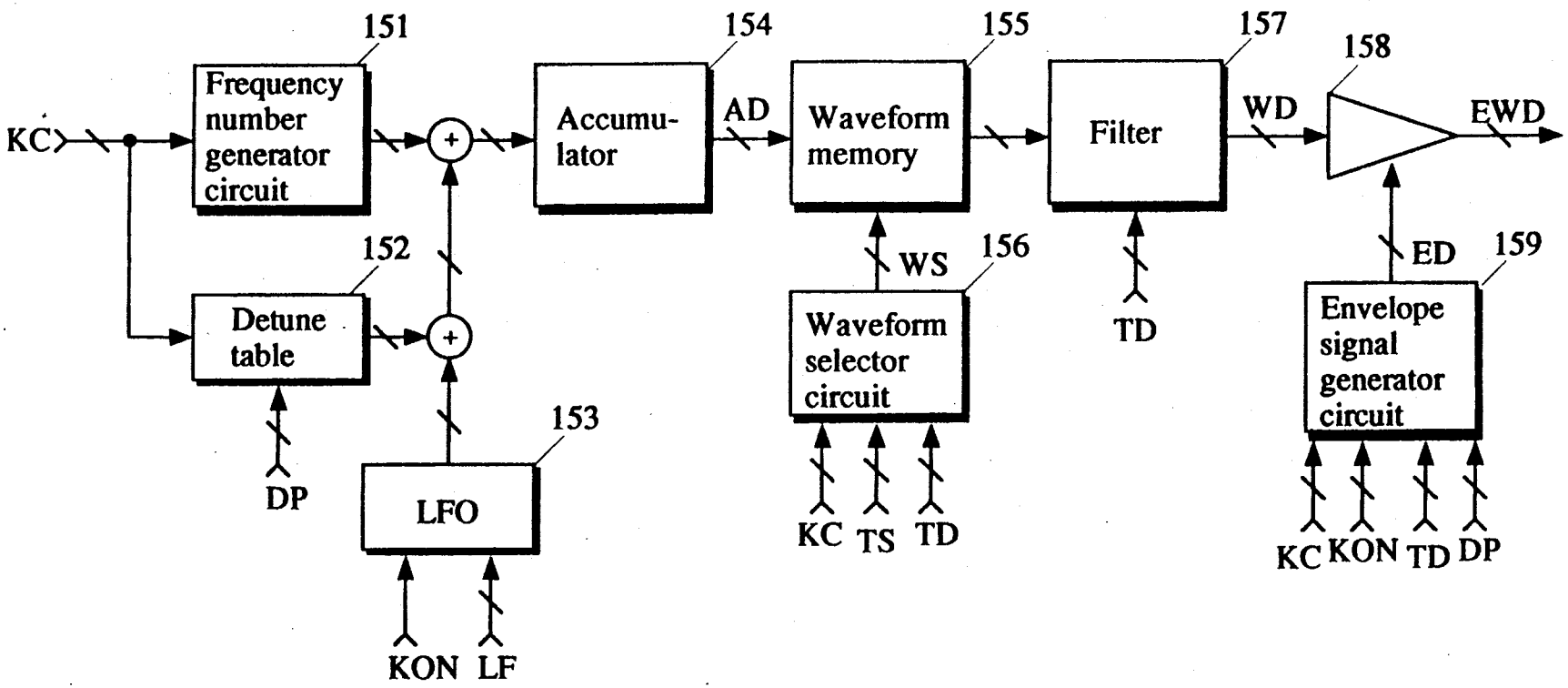
FIG. 2 is a block diagram of a tone synthesizer circuit of the same electronic keyboard instrument.

FIG. 2 is a block diagram of the tone synthesizer circuits 15, where one circuitry thereof is shown out of the three tone synthesizer circuits provided, 15L, 15R, and 15f. The circuitry of the rest is also the same as this one. The shown tone synthesizer circuit comprises a frequency number generator circuit 151, a detune table 152, an LFO 153, an accumulator 154, a waveform memory 155, a waveform selector circuit 156, a filter 157, a multiplier circuit 158, and an envelope signal generator circuit 159. A key code KC input from the key-depression-detector tone-generation-assignment circuit 3 is input to the frequency number generator circuit 151 and the detune table 152. The frequency number generator circuit 151 outputs a frequency number (F number) corresponding to the key code KC out of a ROM contained therein. This F number decides the changing speed of address signals for reading a waveform memory, described later. The detune table 152 has approximately the same assignment as that of the frequency number generator circuit 151, adapted to output a detune signal (small frequency correction signal) according to the damper pedal stamping signal DP. This detune table 152 decides whether the signal output is existing or not depending on whether the pedal is stamped or not, without regard to how deep the damper pedal is stamped. The LFO 153 is a circuit which produces low frequency signals for applying modulation to the F number. By applying modulation to the F number, musical tones generated can be added with such effects as vibratos and tremolos. In this embodiment, it is to be noted that the L- and R-channels are subject to the LFO modulation, without applying it to the ff-channel. That is, the tone synthesizer circuit 15f in FIG. 1 is constructed without including the LFO 153. The LFO 153 operates independently for each time-shared channel, so adapted that the initial phase is set to L=0° and R=90° at te rise edge of the KON for each time-shared channel and that the phase is turned on according to the cycle of the LFO. In this case, however, if the output of the vibrato instruction control 16 is LF=0°, then the resultant settings are L=0° and R=0°. This is because the L- and R-related lines should be of the same phase when no effects by the vibrato instruction control 16 are applied.

The accumulator 154, as described above, has such a function that it receives an F number corrected with the detune signal and LFO effect signal for each time-shared channel and accumulates it for each time-shared channel, thereby calculating an address signal AD for accessing the waveform memory 155. The waveform memory 155 has instantaneous values for each sampling timing from the rise edge to dissipation of tone waveform stored therein in the digital form, whicch instantaneous values can sequentially be read according to the address signal AD to shape a tone waveform. In this case, the pitches of tones can be varied by varying this reading speed.

In order to express such a characteristic of natural musical instruments that tones subtly vary in their tone color with their pitches, it is arranged that a plurality of pitches of tones have been sampled so as to allow these sampling data to be mixed (cross-faded) into generated tones according to their pitches for the formation of tones. Moreover, in the case of an electronic musical instrument capable of generating tones of a plurality of instruments, there are provided sets of sampling waveforms corresponding to their tones.

The waveform memory 155 is connected with the waveform selector circuit 156 which outputs a bank selector signal WS. The waveform selector circuit 159 has input of a key code KC, tone changeover signal TS, and touch detection signal TD, and decides which waveform to be read out in correspondence to these data. More specifically, the waveform memory 155, as stated above, has a plurality of pitches of tones sampled and stored therein to express better the characteristic of natural musical instruments that tones subtly way in tone color, allowing these sampling data to be mixed (cross-faded) into generated tones according to the key code KC. Moreover, the waveform memory 155 has also waveforms stored therein for each tone that can be assigned with a tone changeover switch 14, and according to the tone changeover signal TS the waveform selector circuit 156 switches the bank to the corresponding one. The bank selector signal WS is a signal that shows the leading address of a waveform signal, and if the memory is read on starting with this address according to the AD output by the accumulator, the waveform of any assigned tone cab be formed.

The filter 157 is, for example, a low-pass filter (LPF). In natural musical instruments, there is a characteristic that the lower the level of tone generation the less the amount of higher-order harmonics, while the larger the level of tone generation the higher the ratio occupied by the higher-order harmonics. To simulate this with an electronic musical instrument, here is interposed a filter that cuts higher bands according to the touch data TD of the keyboard 1. This filter is therefore an active filter that varies in pass characteristics according to the TD. The multiplier circuit 158 is a circuit that adds an envelope signal ED to the waveform data WD having passed through the filter 157. The envelope signal ED is formed by the envelope signal generator circuit 159. This circuit outputs the envelope signal ED for each channel in the manner of time-sharing in correspondence to the key code KC, key-on signal KON, touch data TD, and damper pedal stamping signal DP. The envelope signal ED is in general composed of an attack portion immediately after a key-on, a decay portion for sustaining tones that gradually decay, and a release portion effected when a key is turned off without stamping the damper pedal, the waveforms of which portions are created depending on the timing from the point of the key-on or key-off. The circuit 159 is so arranged that when the damper pedal is stamped while a key is on, even if the key os turned off, it generates the same envelope signal as while the key is on until the damper pedal is ceased being stamped, and on the other hand, when the damper pedal is released from being stamped, the circuit generates the envelope signal corresponding to the release portion. The multiplier circuit outputs an envelope-treated waveform signal EWD, which enters the accumulator 10. With the above-mentioned electronic keyboard instrument, when the damper pedal 5 is stamped, the instrument continues to generate the tones currently generated even if the keys are turned off and moveover permits the frequencies (pitches) to be subtly shifted with the result of a wider variety of musical tones.

Figure 3:
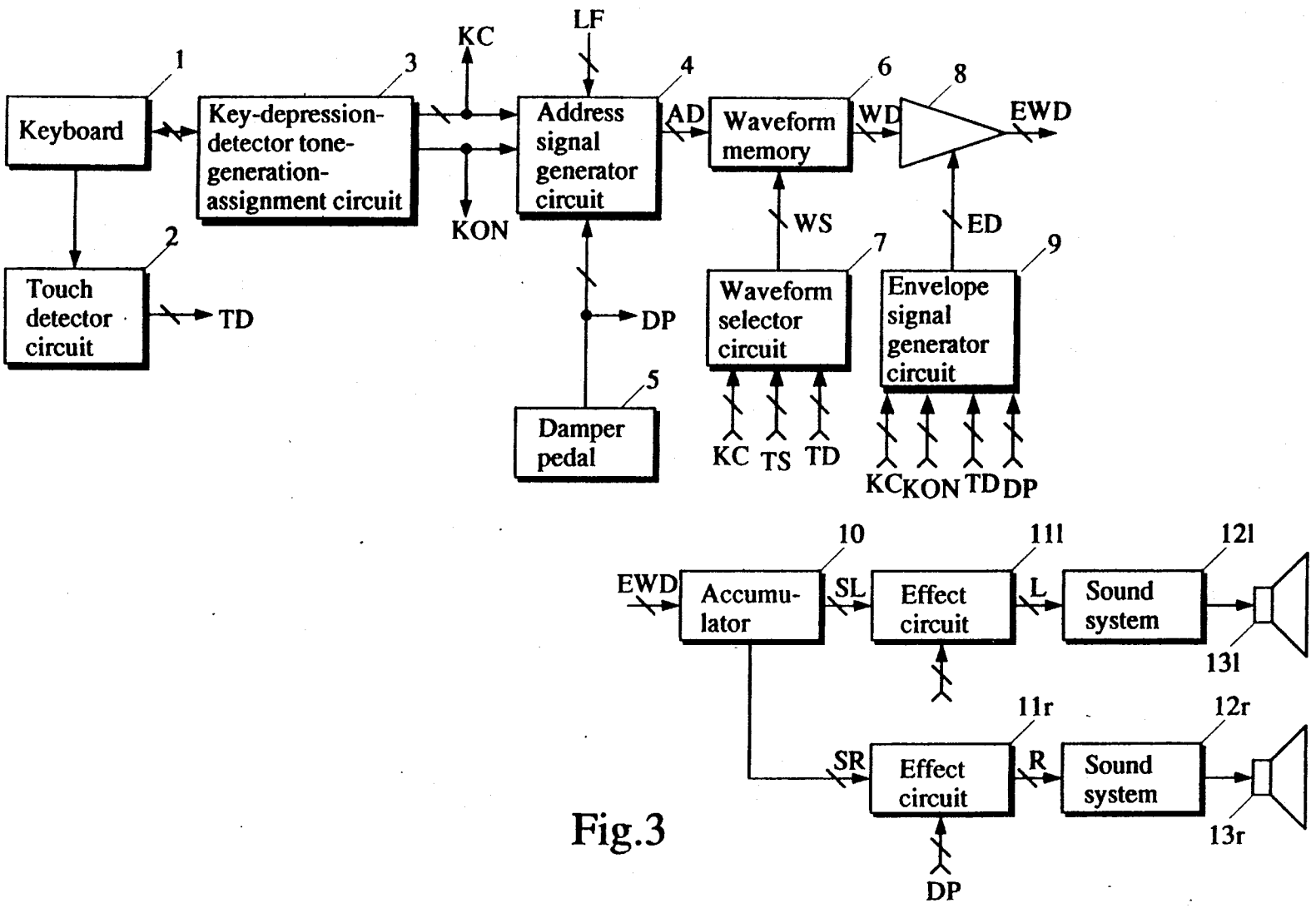
FIG. 3 is a block diagram of an electronic keyboard instrument of another embodiment according to the invention.

FIG. 3 is a block diagram of an electronic keyboard instrument of another embodiment according to the present invention. This electronic keyboard instrument differs from the counterpart shown in FIG. 1 in that the latter is provided with three tone synthesizer circuits for processing L-, R-, and ff-channels in parallel, whereas the former processes all the tone-generation channels (16×3) of the three channels in serial in the manner of time-sharing. Like parts are designated by like reference numerals in the following description as in the construction of the electronic keyboard instrument shown in FIG. 1, omitting the relevant explanation.

Figure 4:
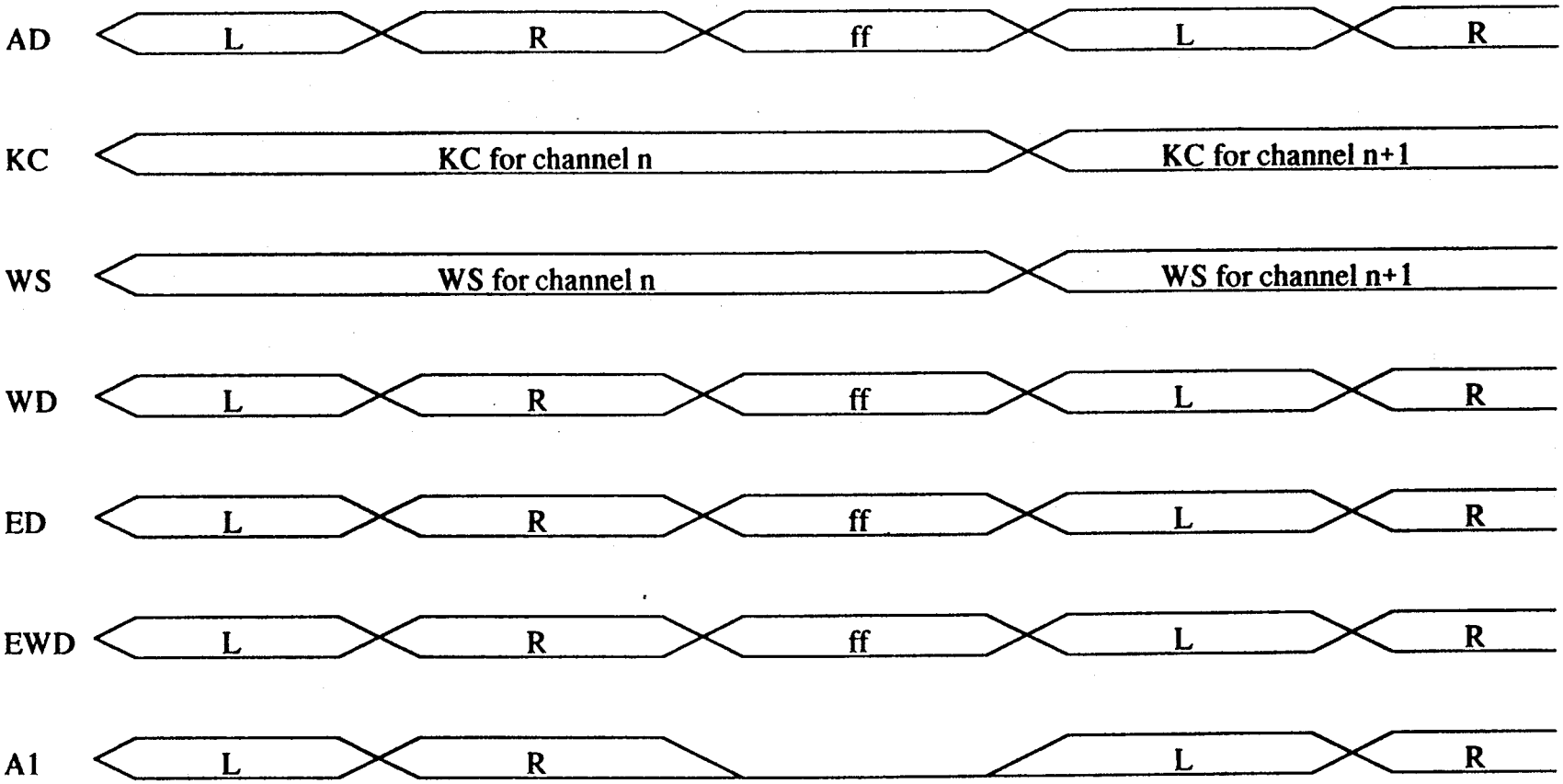
FIG. 4 is a timing chart showing the time-shared timing of an electronic keyboard instrument of a further embodiment according to the invention.

An address signal generator circuit 4 outputs an address signal AD in the manner of time-sharing in correspondence to KC, KON, and a damper pedal stamping signal DP, where, in this embodiment, three address should be output to create three waveforms, L, R, and ff for each key. Accordingly, the address signal AD is output to each of L, R, and ff by further dividing the time-shared timing of a key code (the timing for every 16 tone-generation channels) into three. That is, three addresses are output in the manner of time-sharing for one key code. Alsom to perform detuning among the L-, R-, and ff-related lines depending on how deep the damper pedal is stamped, it is arranged that the pitches in the L and R channels are shifted up or down depending on how deep the damper pedal is stamped. The practical circuitry thereof may be either of the method shown in FIG. 2 or of such one as disclosed in Japanese Utility Model Publication SHO 63-6796, in which the stepping speedd of the address signal AD is subtly shifted for each line. The address signal generator circuit 4 has the DP signal input from the damper pedal 5 as well as the key code KC and key-on signal KON input from the key-depression- detector tone-generation-assignment circuit 3. The address signal generator circuit 4 outputs the address signal AD, which enters into a waveform memory 6. This waveform memory 6 is of the same construction as that of the wave form memory 155 shown in FIG. 2, while a waveform selector circuit 7 is a circuit that feeds the bank changeover signal WS into the waveform memory 6, being of the same construction as that of the waveform selector circuit 156 shown in FIG. 2. These waveform memory 6 and waveform selector circuit 7, however, have a function that they sequentially process in the manner of time-sharing the waveforms of the three L, R, and ff channels, and are adapted to operate according to clock signals in synchronization with the address signal generator circuit 4 and the like. A multiplier circuit 8 serves to cntrol the envelope of waveform. In this case, the control of the mixing degree on each line is also performed in the form of amplitude of envelope. The present embodiment realizes the natural association of touch directions by applying cross-fading between L and R signals resulting from sampling mezzo-forte tones o similar ones and f signals resulting from sampling tones with fortissimo. An envelope signal generator circuit 9 is a circuit that outputs an envelope signal ED in the manner of time-sharing as changed depending on the key code KC, key-on signal KON, touch data TD, and damper pedal stamping signal DP. An accumulator 10 functions to accumulate an envelope-treated time-shared tone signal EWD, release the time-shared state to create L and R signals, and assign them to corresponding channels. The time-shared operating state of the present embodiment is shown in FIG. 4. Three timings, L, R, and ff of an AD signal correspond to one key code. A signal A1 is the timing at which the stereo signal of a time-shared channel can be obtained as it is calculated (cross-faded) between the waveform values of the L- and R-related lines and the waveform value of the ff-related line in which each time-shared channel. The reason why this timing A1 is shifted from the AD by one key code cycle is that the calculation cannot be done unless the L, R, and ff signals are fetched into the accumulator 10. Signals SL and SR can be obtained by summing up the L and R signals of all the time-shared channels obtained at the timing A1.

Although the present embodiment is described primarily with reference to its circuitry, it is also possible to arrange such software as allows the CPU to serve over the range from data input from the keyboard or the like to data output for synthesizing musical tones. The detuning for each lines may be done not with the damper pedal but any other control, as well. Although the present embodiment carries out the fortissimo signal through monaural sampling, the fortissimo waveform may be given each to L and R independently. Although the fortissimo signal is sampled in addition to normal tones (mezzo forte) in this embodiment, pianissimo signals may be sampled to apply crossfading depending on how strong the touch is. Although the present embodiment is so arranged that the DP signal has a value of 3 bits from 0 to 7 depending on how deep the damper pedal 5 is stamped, the detuning also may be varied in its degree depending on this signal. Beside, in the case of an electronic musical instrument that allows a plurality of tones to be selectively changed over, the detuning may be arranged so as to be automatically controlled and changed over according to the tones. Although the LFO for adding effects such as vibratos and tremolos is provided only to the L and R channels in this embodiment, it may also be provided to the ff channel. Still more, although the LFO in the present embodiment is adapted to continuously operate so as to start imparting such effects as vibratos and tremolos with the phase of the LFO at the time when tone generation is started, the initial phase of the LFO may be adapted to be constant for all the tone-generating channels (tone- generating timings).

Furthermore, when a plurality of tones are corresponded to sources capable of simultaneous tone generation, it may be arranged that specific tones are excluded from being subject to effects of the damper pedal.

As described heretofore, according to the present invention, since the operation of a damper control such as a damper pedal allows musical tones shifted in their pitches to be generated even after keys are turned off, the electronic musical instrument can simulate unique sounds of a wider variety such as obtained in the piano, a natural musical instrument, when the damper pedal is stamped.

What is claimed is:

1. An electronic musical instrument comprising:

tone generation instruction means for instructing a generation of a musical tone and a stop of the tone generation;

tone generation means for generating the musical tone according to the instruction of the tone generation instruction means; and a damper control for changing and controlling an aspect of the tone generation in the tone generation means after the stop of tone generation is instructed by the tone generation instruction means, the tone generation means having pitch control means for changing a pitch of the musical tone that is generated when the damper control is operative.

2. An electronic musical instrument as claimed in cliam 1, wherein said damper control is adapted to set said aspect of the tone generation after the stop of the tone generation is instructed by said tone generation instruction means to a state in which the tone generation is sustained.

3. An electronic musical instrument as claimed in claim 2, wherein said damper control is a pedal type operator that can be operated through an up-and-down motion of foot.

4. An electronic musical instrument as claimed in claim 1, wherein said damper control outputs data corresponding to an amount that it is operated, and said pitch control means changes the pitch of the musical tone in accordance with the data.

5. An electronic musical instrument as claimed in claim 1, wherein said tone generation means has a plurality of tone generation channels, and said pitch control means controls at least one or more of the tone generation channels.

6. An electronic musical instrument as claimed in claim 5, wherein said plurality of tone generation channels include left-,right-, and fortissimo-channels, and said pitch control means controls the left and right channnels.

7. An electronic musical instrument as claimed in claim 1, wherein said pitch control means has a detune table for storing pitch change data on the tone generation line of a tone according to said instruction for generating the musical tone.

8. An electronic musical instrument comprising:

first operation means for generating a pitch signal for designating a tone pitch of a musical tone to be generated, a start signal for instructing the start of generation of the musical tone, and a stop signal for instructing the stop of generation of the musical tone;

musical tone generating means for generating the musical tone based on said start signal, the pitch of which is determined based on said pitch signal, so that said musical tone generating means enters a generation state, and for rapidly or gradually stopping generation on of said musical tone based on said stop signal, so that said musical tone generating means enters a non-generating state;

second operation means to be operated;

control means for causing said musical tone generating means to sustain said generating state when said second operation means is operated even if said stop signal is generated;

pitch control means for controlling said musical tone generating means to change said pitch of said musical tone when said second operation means is operative.

9. An electronic musical instrument as claimed in claim 8, wherein said first operation means comprises a musical keyboard having a key for generating a key code signal as said pitch signal, a key-on signal as said start signal, and a key-off signal as said stop signal.

10. An electronic musical instrument as claimed in cliam 8, wherein said second operation means comprises a pedal type operator which is operated by a foot of a player through an up-and-down motion.

11. An electronic musical instrument as claimed in claim 8, wherein said pitch control means controls said musical tone generating means to fine shift said pitch of said musical tone when said second operation means is operated.

12. An electronic musical instrument as claimed in claim 8, wherein said second operation means includes detection means for detecting an operation amount of said second operation means and generating an amount siganl representing said operation amount, wherein said control means controls said musical tone generating means to shift said pitch of said musical tone according to said amount signal, so that the shifting amount changes according to the operation amount.

13. An electronic musical instrument as claimed in claim 12, wherein said pitch control means includes table means in which relevance between said operation amount and said shifting amount is stored.

14. An electronic musical instrument as claimed in claim 8, wherein said musical tone generating means comprises a plurality of musical tone generators that start to generate musical tones simultaneously based on said start signal, wherein said pitch control means controls at least one of said plurality of musical tone generators to change pitches of said musical tones.

15. An electronic musical instrument comprising:

first operation means for generating a pitch signal for designating a tone pitch of a musical tone to be generated, a start signal for instructing the start of generation of the musical tone, and a stop signal for instructing the stop of generation of the musical tone;

envelope control means for controlling an amplitude of the musical tone, which includes first envelope data for controlling the amplitude from a time when said start signal is generated to a time when said stop signal is generated and second envelope data for controlling the amplitude after said stop signal is generated;

musical tone generating means for generating the musical tone based on said start signal, the pitch of which is determined based on said pitch signal, the amplitude of which is controlled based on said first envelope data before the generation of said stop signal, and the amplitude of which is controlled based on said second envelope data after the generation of said stop signal;

second operation means to be operated, wherein said amplitude of said musical tone after the generation of said stop signal is controlled based on said first envelope data when said second operation means is operated;

pitch control means for controlling said musical tone generating means to change said pitch of said musical tone when said second operation means oprative.

16. An eletronic musical instrument as claimed in claim 15, wherein said second operation means includes a detection means for detecting an operation amount of said second operation means and generating an amount signal representing said operation amount, wherein said control means causes said musical tone generating means to shift said pitch of said musical tone according to said amount signal, so that the shifting amount changes according to the operation amount.

17. An electronic musical instrument as claimed in claim 16, wherein said pitch control means includes table means in which relevance between said operation amount and said shifting amount is stored.

18. An electronic musical instrument as claimed in claim 15, wherein said musical tone generating means comprises a plurality of musical tone generators that start to generate musical tones simultaneously based on said start signal, wherein said pitch control means controls at least one of said plurality of musical tone generators to change the pitches of said musical tones.

* * * * *